United States Patent [19]

Martin et al.

[11] Patent Number: 5,048,748

[45] Date of Patent: Sep. 17, 1991

[54] SINGLE SHEET SELF-MAILER FORM WITH IMPROVED OPENING CHARACTERISTICS

[76] Inventors: Samuel W. Martin, Martin Rd., Weston, Conn. 06883; Morton Silverberg, 24 Edgewater Commons La., Westport, Conn. 06880

[21] Appl. No.: 356,901

[22] Filed: May 24, 1989

[51] Int. Cl.[5] ..... B65D 27/34

[52] U.S. Cl. ..... 229/92.1

[58] Field of Search ..... 229/92.1, 92.3, 92

[56] References Cited

U.S. PATENT DOCUMENTS

| | | | |
|---|---|---|---|
| 830,844 | 9/1906 | Nichols | 229/92.7 |
| 1,518,183 | 12/1924 | Dailey . | |
| 1,597,866 | 8/1926 | Peeff . | |
| 1,870,909 | 8/1932 | Hoffmann | 229/92.1 |
| 2,773,639 | 12/1956 | Krohn | 229/92.1 X |
| 3,217,972 | 11/1965 | McNelis | 229/92.1 |
| 3,306,632 | 2/1967 | Stahmer | 229/92.1 |
| 3,352,481 | 11/1967 | Kirchof | 229/92.1 |
| 3,523,638 | 7/1968 | Moonan | 229/92.1 |
| 3,902,655 | 9/1975 | Huffman | 229/69 |
| 3,995,808 | 12/1976 | Kehoe | 229/73 |
| 3,998,138 | 12/1976 | Walters . | |
| 4,566,627 | 1/1986 | Gendron | 229/81 |
| 4,668,211 | 5/1987 | Lubotta et al. | 493/188 |
| 4,784,317 | 11/1988 | Chen et al. | 229/92.3 |

FOREIGN PATENT DOCUMENTS

| | | | |
|---|---|---|---|
| 374810 | 5/1923 | Fed. Rep. of Germany | 229/92.1 |
| 97300 | 6/1924 | Fed. Rep. of Germany | 229/92.1 |
| 520296 | 6/1921 | France | 229/92.1 |
| 46983 | 1/1909 | Switzerland | 229/92.1 |
| 21278 | of 1892 | United Kingdom | 229/92.1 |
| 15215 | of 1900 | United Kingdom | 229/92.1 |
| 1370025 | 10/1974 | United Kingdom | 229/92.1 |

*Primary Examiner*—Stephen Marcus
*Assistant Examiner*—Jes F. Pascua
*Attorney, Agent, or Firm*—Robert H. Whisker; David E. Pitchenik; Melvin J. Scolnick

[57] ABSTRACT

A self-mailing form suitable for use with laser printers and the like. The form is made from a single sheet of paper stock and comprises a rectangular upper portion and a rectangular lower portion joined by a connecting portion. The lower portion is printed with message information and the upper portion is printed with address information and the like. The form is then folded once about the upper edge of the connecting portion so that the obverse sides of the upper and lower portions are adjacent and then again so that the upper edge of the upper portion is brought to the lower edge of the connecting portion, so that the upper portion forms an envelope around the lower portion. Adhesive is applied around the edges of the upper portion to seal the resulting envelope. Perforation lines are provided transversely across the form so that after folding a tear-off strip is formed which includes the connecting portion. Thus, when the recipient removes the tear off strip, the lower portion is separated from the upper portion simultaneously with opening of the envelope.

4 Claims, 3 Drawing Sheets

SINGLE SHEET SELF-MAILER FORM WITH IMPROVED OPENING CHARACTERISTICS

BACKGROUND OF THE INVENTION

This invention relates to a one-piece self-mailer form suitable for use with computer output printers, particularly laser printers. More particularly, it relates to a self-mailing form formed from a single sheet of paper stock and suitable for use in a system for continuous printing, folding, and sealing operations in an office environment.

Single sheet self-mailer forms are, in general, well known. With such forms persons may print or type a message then fold and seal the form into a mail piece suitable for mailing; hence the name self-mailer. With the advent of high speed computer driven printers, the need for such forms as a convenient method for producing computer generated mail has become evident. While no doubt, most people are familiar with the many varieties of self-mailer forms which have been produced for use with computer generated mail, in general these mailers have been produced from continuous webs of stock and are intended for use on the high speed printers of main frame computers. To date, there have been no fully satisfactory forms developed which are suitable for use in a continuous printing, folding and sealing operation in an office environment.

U.S. Pat. No. 3,995,808; to: Kehoe; for: UNIT CONTAINING VARIABLE MESSAGES; issued: Dec. 7, 1976 discloses what is believed to be the closest prior art. In the Kehoe patent, a form comprising a first portion which is folded about a second portion to form an envelope containing the second portion, on which a message may be printed, is disclosed. This form also includes three lines of perforations which, when the form of Kehoe is folded and sealed, are aligned so that the resulting mail piece may be opened, and the message bearing portion separated from the form simply by tearing off a strip along the line of the aligned perforations. In one embodiment taught by Kehoe a web of paper stock is first printed, then appropriately cut and perforated, then adhesive is applied, then the web is folded along lines parallel to the direction of motion to form a continuous web of sealed envelopes, and the sealed envelopes cut to form separate mail pieces. It is readily apparent that, particularly because of the manner in which the paper stock is folded and then separated, such a system must be physically very large to prevent tearing of the paper stock during folding, as well as to provide for the additional steps of cutting and perforating, and applying adhesive. Clearly, such forms are not intended for use in an office environment (e.g. for use with microcomputer controlled printers such as laser printers). Kehoe does briefly disclose that single sheet forms may be printed on what Kehoe refers to as a computer-controlled copier, then folded and perforated and then placed in a window envelope. (Note Kehoe Col. 7, lines 51-62) This clearly teaches away from the use of the forms of Kehoe as a one step self-mailer in an office environment.

U.S. Pat. No. 4,784,317; to: Chen et al.; for: ONE PIECE MAILER FOR LASER PRINTER; issued: Nov. 15, 1988 discloses a one piece self-mailer for use with a laser printer. The form of Chen et al. consists of an upper and lower portion where an address, return address, and message may be printed on the upper portion, and the message continued onto the lower portion.

The lower portion is then folded up so that the printed material is within the envelope form, and the resulting envelope is sealed. The lower portion is provided with windows so that the address and return address are visible. Note that this embodiment taught by Chen et al. does not provide a mailer which is folded and sealed to form an addressed enveloped with a separable message bearing portion enclosed within the envelope.

Chen et al. also disclose a second embodiment having an upper portion on which a message may be printed and a lower portion consisting of a detachably connected envelope, so that the envelope may be addressed as the message is printed. After the message and envelope are printed, the message is detached from the envelope, inserted into the envelope, and the envelope sealed. This clearly teaches away from a continuous printing, folding and sealing process.

Thus, it is an object of the subject invention to provide an improved self-mailer which is suitable for use with laser printers and similar office equipment. It is a further object of the subject invention to provide a one piece self-mailer which is suitable for use in a continuous (with respect to each separate form) printing, folding, and sealing operation.

BRIEF SUMMARY OF THE INVENTION

The above objects are achieved in accordance with the subject invention by means of a self-mailing form which is formed from a single sheet of stock and includes a substantially rectangular upper envelope portion having a width $w_1$ and length $d_1$. The sheet is weakened along two transverse lines, such as lines of perforations, lying within the upper portion and respectively parallel to the upper and lower edges of the upper portion, and respectively spaced from the upper and lower edges by a predetermined distance $d_3$. A substantially rectangular connecting portion is attached to the lower edge of the upper portion and has a length equal to $d_3$. The connecting portion extends substantially along the entire length of the lower edge of the upper portion. The form also includes a substantially rectangular lower message portion having a width $w_2$ and length $d_2$. The lower portion is attached to the lower edge of the connecting portion along its upper edge, and the line of attachment is weakened, such as by a line of perforations. The form also includes a mechanism to seal the form once it has been folded; preferably a line of adhesive applied adjacent to and along the longitudinal edges of the upper portion and the upper edge of the upper portion on the obverse side.

After printing of addressing information on the reverse side of the upper portion and message information on the reverse side of the lower portion, the form may be folded and sealed by first folding the obverse side of the connecting portion and the lower portion to the obverse side of the upper portion around the lower edge of the upper portion and then transversely folding the upper portion to bring the upper and lower edges together to form an envelope around the lower portion.

Thus, it may be seen that the form of the subject invention advantageously overcomes the disadvantages of the prior art in that it provides a single sheet self-mailer form which is suitable for use with laser printers and similar office equipment and in a continuous printing, folding, and sealing operation, without need for window envelopes, and which further may be folded and sealed to provide an addressed envelope, without windows, which encloses a separable message bearing portion.

Other objects and advantages of the subject invention will be apparent to those skilled in the art from consideration of the attached drawings and the detailed description of preferred embodiments set forth below.

DETAILED DESCRIPTION OF PREFERRED EMBODIMENTS

Figure 1:
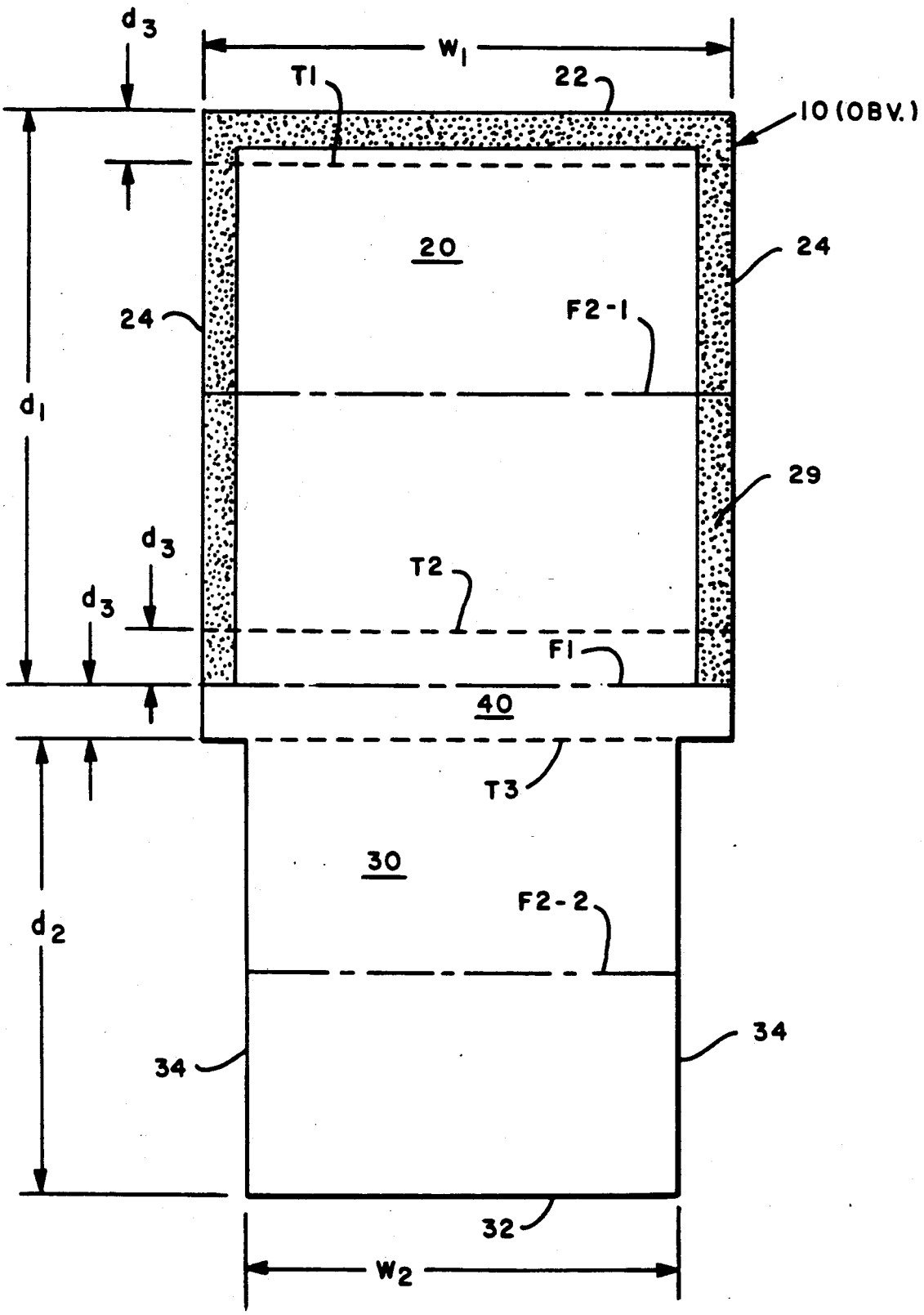
FIG. 1 shows a plan view of the obverse side of a one piece self-mailer form in accordance with the subject invention.

FIG. 1 shows a plan view of the obverse side of form 10. Form 10 includes a substantially rectangular upper portion 20 bounded by upper edge 22, longitudinal edges 24, and at its lower edge by fold line F1. Upper portion 20 also includes a second transverse fold line F2-1 parallel to line F1 connecting the midpoints of edges 24. Preferably, line F2-1 is scored and line F1 is scored or perforated to facilitate folding of form 10, as will be described further below.

Form 10 is weakened, preferably by perforations, along tear lines T1 and T2 which, respectively, are located parallel to and spaced below edge 22, and parallel to and spaced above fold line F1 by equal distances $d_3$.

Adhesive 29 is applied in a strip adjacent edges 24 and 22 to seal form 10 after folding, as will be described further below. Adhesive 29 is preferably an adhesive which will not be affected by the heat of a laser printing process, and more preferably is a conventional water activated adhesive.

Lower portion 30 is provided in form 10 for printing of message information, and has a length $d_2$ and a width $w_2$. Lower portion 30 is bounded by lower edge 32 and longitudinal edges 34. At its upper edge lower portion 30 is connected to connecting portion 40 along tear T3 line. Form 10 is weakened along line T3, preferably by perforation, to facilitate separation of lower portion 30. Lower portion 30 also includes fold line F2-2, which may be scored or perforated to facilitate folding, as will be described further below. Where line F2-2 is weakened by perforations lower portion 30 may be printed as two parts; for example, a bill and a portion to be returned with payment.

Connecting portion 40 is substantially rectangular extends from fold line F1 to tear line T3 and also has a length, $d_3$. Connecting portion 40 extends outwardly along fold line F1 and extends tear line T3 to reach substantially to edges 24.

Extending tear line T3 to reach edges 24 (i.e. so that it is substantially co-extensive with lines T1 and T2) increases assurance that the tear between connecting portion 40 and lower, message portion 30 will propagate smoothly and not veer into message portion 30.

Figure 2:
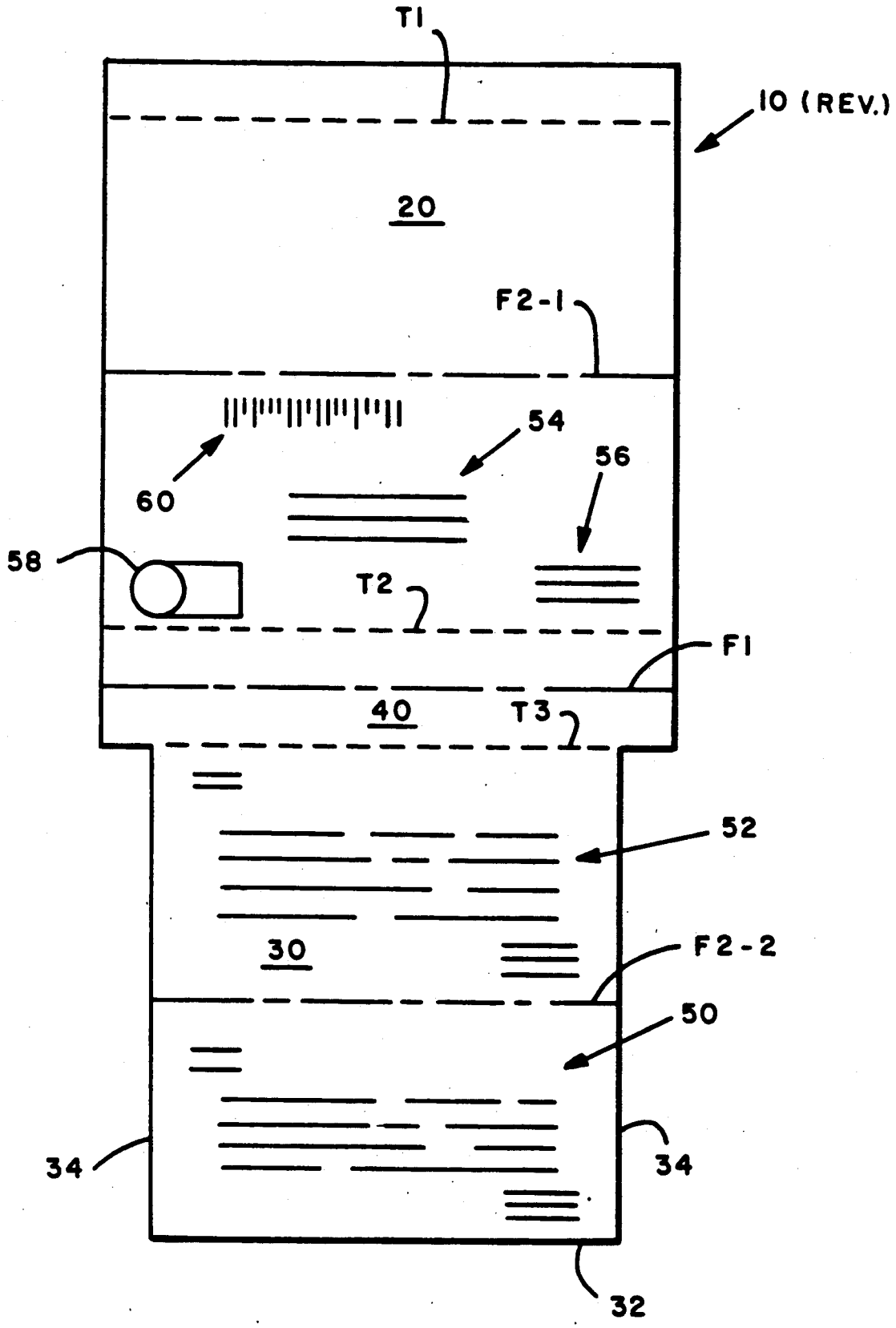
FIG. 2 shows a plan view of the reverse side of the form of FIG. 1 and also shows a typical arrangement of information printed on the form of FIG. 1.

FIG. 2 shows the reverse side of form 10. As form 10 passes through a laser printer or the like, message information 50, 52 is printed on the reverse side of lower portion 30. As was described above, fold line T3 may be perforated and message information 50 may be, for example, a bill or invoice and message information 52 may be information for a return portion to be returned with payment.

After printing of message information 50,52 address information 54 and return address information 56 may be printed by the laser printer on upper portion 20 between fold line F2-1 and tear line T2. Additionally, franking information 58, such as a penalty mail permit number and bar code information 60 to facilitate handling by the postal service may also be printed on upper portion 20 between lines F2-1 and T2. Also, fixed information such as return address information 56 or franking information 58 may be preprinted on form 10.

Figure 3:
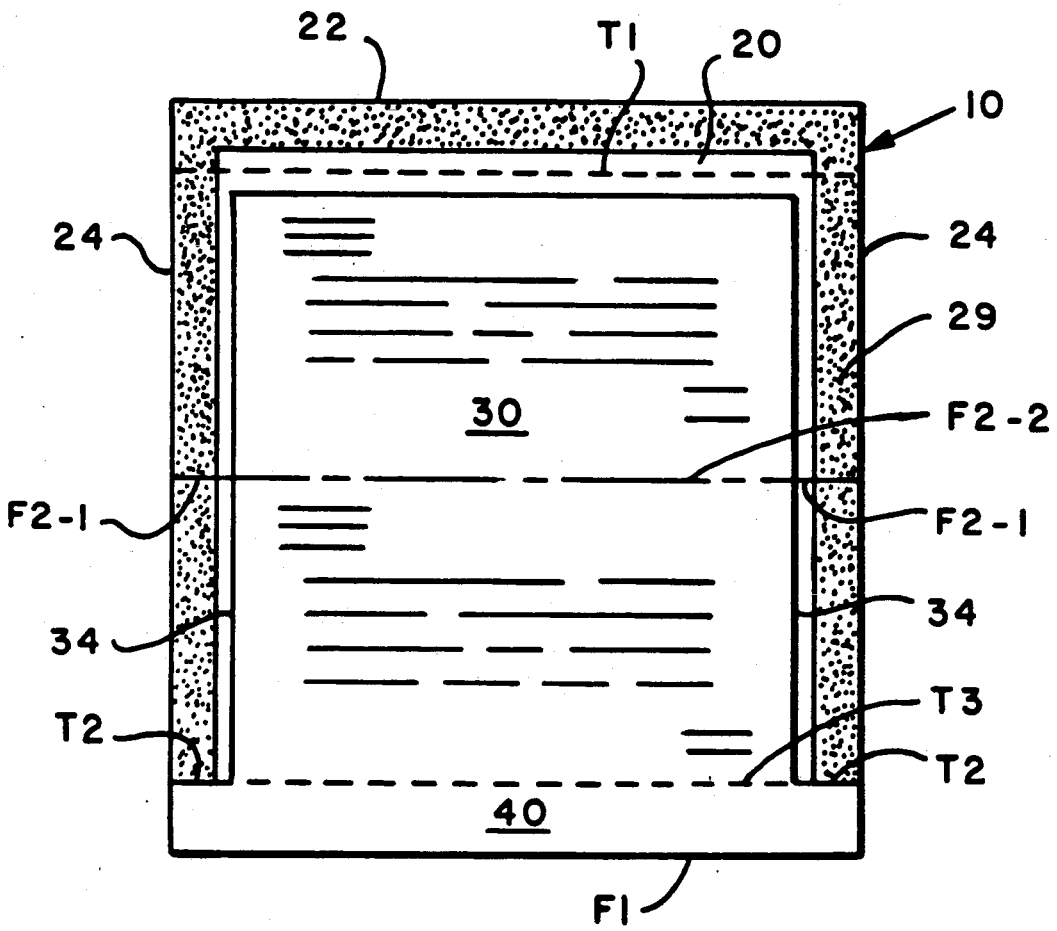
FIG. 3 shows a plan view of the form of FIGS. 1 and 2 after the first fold.

FIG. 3 shows the first step of folding of form 10. Form 10 is folded about fold line F1 so that the obverse sides of upper and lower portions 20 and 30 are adjacent. Note that tear lines T3 and T2 are aligned after folding as are fold lines F2-1 and F2-2.

Figure 4:
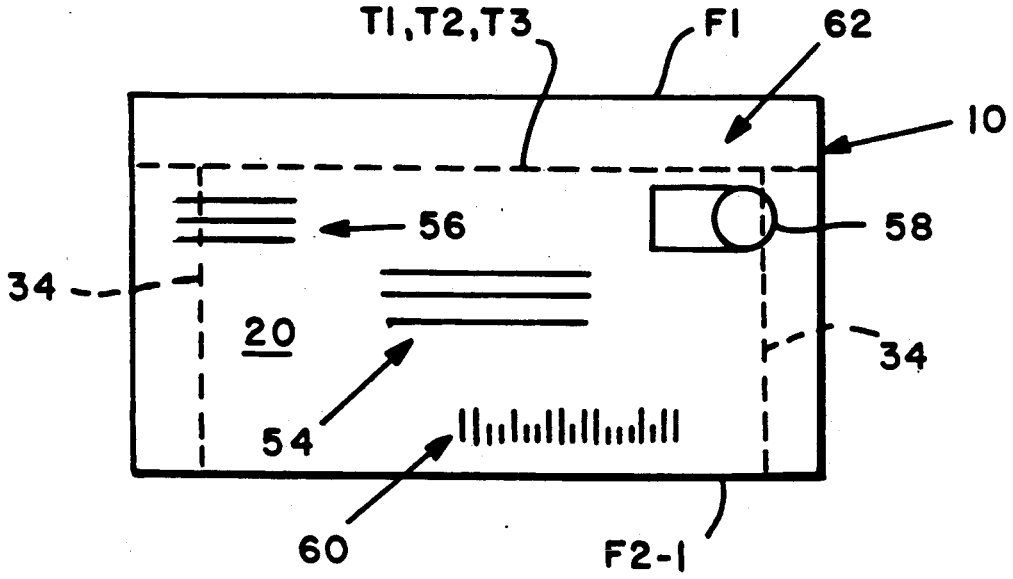
FIG. 4 shows a plan view of the form of FIG. 3 after the second folding and sealing operation.

FIG. 4 shows form 10 after printing, final folding, and sealing. Form 10 now comprises a mail piece suitable for delivery by the Postal Service. In the final folding, form 10 is folded around fold lines F2-1 and F2-2 so that adhesive 29 seals the obverse side of upper portion 20 along longitudinal edges 24 and the obverse side of upper portion 20 along edge 22 to connecting portion 40. Note that tear line T1 is now aligned with lines T2 and T3 to form a tear off strip 62 comprising connecting portion 40. To open the mail piece, the recipient simply grasps tear off tear off strip 62 and tears it along lines T1, T2, and T3. This detaches lower portion 30 from upper portion 20 when connecting strip 40 is removed, and, because dimensions $w_2$ and $d_2$ are selected so that lower portion 30 does not contact adhesive 29, as can be seen in FIG. 3, it appears to the recipient that lower portion 30 is a separate sheet contained in an envelope formed by upper portion 20. The length of lower portion 30 is also chosen so that $d_2$ is less than or equal to $d_1$-$2d_3$ to assure that lower portion 30 fits properly within the envelope.

Example

A satisfactory self-mailing form in accordance with the subject invention has been produced from 24 pound woven, envelope stock and has dimensions:

$w_1 \sim 8\frac{1}{2}$ inches
$d_1 \sim 7\frac{3}{8}$ inches
$w_2 \sim 7\frac{3}{8}$ inches
$d_2 \sim 6\frac{1}{8}$ inches
$d_3 \sim \frac{1}{2}$ inch A satisfactory adhesive is a water activated dextrin/resin based adhesive. Approximately 0.0003 inches of glue thickness yields a sufficient bond to produce fiber tearing if an attempt is made to tamper with the seal, given that adequate pressure is applied to the seal.

Assuming that the lower portion is fed first, tear line $T_3$ may be made stronger to withstand the stresses of a mechanical folding operation, while $T_1$ and $T_2$ may be somewhat weaker to facilitate separation. The preferred strengths of tear lines $T_1$, $T_2$ and $T_3$ will depend on the details of the particular folding process used and may be readily determined by experimentation.

Those skilled in the art will recognize that numerous other embodiments of the subject invention may be developed from the above detailed descriptions and attached drawings. Particularly, it will be apparent that the length of lower portion 30 may be extended substantially to include additional room for message information and even return envelopes, provided there is preliminary folding of lower portion 30 so that after final folding, it is not in contact with adhesive 29. Accordingly, it is to be understood that the above detailed description and attached drawings are provided by way of illustration only, and that limitations on the subject invention are to be found only in claims set forth below.

What is claimed is:

1. A self-mailer form, comprising:

a) a substantially rectangular upper portion having opposed upper and lower edges and opposed longitudinal edges, said upper portion being weakened along a first transverse line substantially extending between said longitudinal edges substantially parallel to, and spaced from said upper edge of said upper portion by a predetermined distance, and being weakened along a second transverse line substantially co-extensive with and parallel to said first line, said said second line being spaced from said lower edge by said predetermined distance;

b) a substantially rectangular lower, message portion having a width less than said upper portion, and having opposed upper and lower edges and opposed longitudinal edges;

c) a substantially rectangular connecting portion attached along said lower edge of said upper portion and said upper edge of said lower portion having a length substantially equal to said predetermined distance, said form being weakened along said upper edge of said lower portions; wherein, d) the dimensions of said upper portion and said lower portion are chosen so that, after a first folding of said form around said lower edge of said upper portion, a second folding of said form around a transverse fold line substantially bisecting said upper portion, and sealing of said longitudinal edges of said upper portion and said upper edge of said upper portion and said upper edge of said upper portion to said connecting portion, a mail piece is formed containing said lower portion, said lower portion being attached to said mail piece only be attachment to said connecting portion along said upper edge of said lower portion; and, e) said form is weakened along said upper edge of said lower portion relatively less than along said transverse lines by an amount selected to allow said form to withstand the stresses of mechanical folding operation.

2. A form as described in claim 1 wherein said weakened lines are weakened by perforations.

3. A form as described in claim 1 further comprising sealing means for sealing said longitudinal edges of said upper portions, and of said upper edge of said upper portion to said connecting portion after said foldings.

4. A form as described in claim 1 wherein said form is preprinted with information such as return address and bar code.

* * * * *